US008997759B2

(12) United States Patent
Wolfsgruber

(10) Patent No.: US 8,997,759 B2
(45) Date of Patent: Apr. 7, 2015

(54) APPLICATOR WITH TUBULAR, OVERMOLDED CORE ELEMENT

(75) Inventor: Dieter Wolfsgruber, Burgoberach (DE)

(73) Assignee: GEKA GmbH, Bechhofen (DE)

( * ) Notice: Subject to any disclaimer, the term of this patent is extended or adjusted under 35 U.S.C. 154(b) by 442 days.

(21) Appl. No.: 13/398,145

(22) Filed: Feb. 16, 2012

(65) Prior Publication Data

US 2012/0211019 A1 Aug. 23, 2012

(30) Foreign Application Priority Data

Feb. 16, 2011 (DE) ..... 20 2011 002 793 U

(51) Int. Cl.

| | |
|---|---|
| ***A45D 40/26*** | (2006.01) |
| ***A46B 9/02*** | (2006.01) |
| ***A46B 3/00*** | (2006.01) |
| ***A46D 1/00*** | (2006.01) |

(52) U.S. Cl.

CPC ..... *A46B 9/021* (2013.01); *A46B 3/005* (2013.01); *A46D 1/00* (2013.01); *A46B 2200/1053* (2013.01)

(58) Field of Classification Search

USPC ..... 15/187, 188, 207.2; 132/218, 320

See application file for complete search history.

(56) References Cited

U.S. PATENT DOCUMENTS

| | | | | |
|---|---|---|---|---|
| 7,503,093 | B2 * | 3/2009 | Weihrauch | 15/187 |
| 2005/0034740 | A1 | 2/2005 | Eckers et al. | |
| 2007/0033760 | A1 * | 2/2007 | Dumler | 15/187 |
| 2007/0256700 | A1 * | 11/2007 | Bodelin | 132/218 |

FOREIGN PATENT DOCUMENTS

| | | | |
|---|---|---|---|
| EP | 1752063 | A1 | 2/2007 |
| WO | 02056726 | A2 | 7/2002 |
| WO | 2010149366 | A1 | 12/2010 |

* cited by examiner

*Primary Examiner* — Todd Manahan
*Assistant Examiner* — Brianne Kalach
(74) *Attorney, Agent, or Firm* — Setter Roche LLP

(57) ABSTRACT

The invention relates to a cosmetics applicator having a handle section, an applicator element and a shaft section connecting the applicator element and the handle section, wherein the applicator element includes a core element of a first material and a bristle element which at least partially envelops the core element and includes a second material preferably different from the first material with regard to its hardness and/or flexibility.

11 Claims, 4 Drawing Sheets

APPLICATOR WITH TUBULAR, OVERMOLDED CORE ELEMENT

FIELD OF THE INVENTION

The invention relates to a cosmetics applicator as well as to an applicator element forming a constituent of such a cosmetics applicator.

BACKGROUND OF THE INVENTION

Cosmetics applicators whose applicator elements consist of a core element of a first material and a bristle element of a second material which envelops the core element at least partially are already known.

For example, the patent application EP 1 752 063 describes a cosmetics applicator with a core element of a first plastic, which is referred to therein as a basic body, onto which a tubular bristle body of a second plastic is pulled. In this patent application, the tubular bristle body and the core element are manufactured separately. Subsequently, the tubular bristle body is pulled onto the core element like a stocking and fixed thereon by positive fit by an end cap being provided which reaches over the distal end of the tubular bristle body, thus retaining it on the basic body. In addition, the bristle body is latched onto the basic body by comprising a groove into which a corresponding projection of the basic body engages.

This separate manufacture of the two elements, which makes a subsequent assembly step inevitable, is very expensive.

The international patent application WO 02/056726 describes a cosmetics applicator with a core element which is referred to therein as a "stiffening core". This core element has a massive cross section. This core element is surrounded by a carrier sleeve of a different plastic. In this case, this cosmetics applicator is manufactured in such a way that the carrier sleeve is injection-molded in a thin layer onto the outer surface of the massive core element with the purpose of the carrier sleeve and the core element being welded or at least glued together during the injection molding process. However, this welding or gluing process occurs to a sufficient extent only if the plastic material of the carrier sleeve and the plastic material of the core element are matched to one another. Obviously, this problem has also not escaped the attention of the author of the international patent application. Therefore, it is proposed, inter alia, to provide the core element with a number of blind holes extending with their longitudinal axis in the radial direction, into which the still-liquid plastic molding compound of the carrier sleeve is supposed to enter to a locally limited extent in order to ensure a better purchase of the carrier sleeve on the core element. However, this workaround measure works only to a limited extent or, in any case, entails drawbacks. If only small blind holes are provided that do not weaken the core element substantially, there is the danger of the blind holes, which are not vented, are insufficiently filled by the melt and thus do not perform their intended function properly. In contrast, larger blind holes, which were not proposed by WO 02/056726 in the first place, would lead to the core element being weakened considerably. Moreover, this structure can be produced only with difficulties. In particular if the applicator element has a not inconsiderable extent in the longitudinal direction, it may prove difficult to press sufficiently molten plastic molding compound quickly enough into all of the bristle-forming cavities of the mold, which are of course very thin.

In light of this, it is an object of the invention to propose a cosmetics applicator whose applicator element is formed from two parts, i.e. that it consists of a core element and a bristle element subsequently injection-molded onto the core element, with the core element and the bristle element being reliably interconnected by injection molding independent of the materials selected for them.

SUMMARY OF THE INVENTION

Accordingly, the cosmetics applicator according to the invention consists of a handle section, an applicator element and a shaft section connecting the applicator element and the handle section. In this case, the applicator element itself consists of a core element of a first material and a bristle element of a second material which envelops the core element at least partially. In this case, the term "bristle element" is preferably to be understood in a narrower sense and refers to an element comprising ideally flexible fingers protruding outwardly in a rod-like manner, whose dimensions are considerably larger in the radial direction than their dimensions in the circumferential direction and the longitudinal direction. These fingers are preferably configured in such a way that their free length with which they protrude from the bristle carrier tube is at least five times, better at least seven times larger than their largest diameter. However, in certain cases the term bristle element may also be understood in a broader sense and then be an element which carries disc- or disc segment-like application organs protruding outwardly in the radial direction. Said first material and said second material are preferably different from one another. In a few cases, which are, however, not preferred, the two materials are the same so that the sole difference lies in the fact that the core element is first injection-molded and the bristle element is then injection-molded onto it. According to the invention, it is provided that the core element comprises a tube section which is hollow inside in the direction along its longitudinal axis and thus forms a cavity. Preferably, the tube section forming the cavity is configured in such a way that the cavity, seen in the longitudinal direction, extends wholly or at least substantially through the entire area which later, in the finished state, is occupied by the bristle element. This cavity is then, in the finished state, completely or at least substantially completely filled by the second material of the bristle element. Integrally therewith, the bristle element at the same time forms a bristle carrier tube covered with outwardly protruding bristles which envelops the outer jacket of the tube section completely or at least in some areas completely. Due to the fact that the bristle element surrounds the tube section of the core element not only on the outer circumferential surface thereof, but instead at the same time also latches into the large cavity extending along the longitudinal axis of the tube section, the purchase that the bristle element finds on the core element is increased several times. It is thus ensured that the core element and the bristle element are sufficiently firmly interconnected even if they consist of different materials, which cannot be welded or glued together, or only barely, or in any case not sufficiently.

The cavity is preferably configured in such a way that an unchangeable fixation is provided, by overmolding the core element, between the bristle element and in particular the bristle carrier tube and the core element in the sense that, on the contact surfaces between the core element and the bristle carrier tube at least, no relative movements occur between these two components, neither in the direction of the longitudinal axis nor in the circumferential direction.

It thus becomes possible to manufacture the bristle element and the core section from a variety of materials, and in particular from a hard-elastic plastic (core section) and a soft-elastic to rubber-elastic plastic (bristle element). Not only a variety of plastics are possible, including such plastics that do not exhibit any tendency to be glued or welded together, but also combinations of totally different material groups. It thus becomes possible, for example, to manufacture the core element from metal and the bristle element from a soft plastic which is injection-molded onto the metal of the core element. In addition, the flexibility of the core area bearing the bristles on its outer face can be adjusted rather delicately if required and if correspondingly different materials are selected for the core element and the bristle element. The flexibility becomes the larger, the greater the diameter of the cavity is, i.e. the stronger the contribution to the formation of the cross section of the core area by the material of the bristle carrier that tends to be more flexible.

In the context of a preferred embodiment, it is provided that the tube section of the core element, in the area of the distal end thereof facing away from the handle section, comprises at least one first opening through which material can be injected into the cavity of the core element during the production of the cosmetics applicator, and that the tube section of the core element, in the area of the proximal end thereof facing towards the handle section, comprises at least one second opening through which the previously injected material can exit the cavity of the core element again during the production of the cosmetics applicator, with the material exiting again preferably forming at least a part of the bristle carrier tube enveloping the outer jacket of the tube section, optionally, however, additionally also a part of the bristles. Since the large-volume cavity, which is thermally insulated from the cold surfaces of the steel mold, does not appreciably impede the melt flow, it thus becomes possible to let the melt be injected almost synchronously from two or more sides into the critical area of the narrow gap between the outer face of the core element and the cold inner face of the steel mold. This reduces the risk of the melt having cooled off too much already when it has reached the bristle-forming cavities of the injection mold that are furthest from the area in which the molten plastic molding compound that is to form the bristle element and the bristles is first injected into the mold.

In a particularly preferred embodiment, it is provided that the finished injection-molded bristle element also covers the distal end face of the core element completely, so that the tube section is substantially completely embedded inside the bristle element, or the tube section of the core element is substantially completely enveloped by the bristle element. This reduces the danger of fine separating joints that promote the growth of fungi and bacteria forming between the core element and the possibly very different material of the bristle element.

In another preferred embodiment, the mouth of the at least one opening pointing outwards lies at least substantially in a plane extending perpendicularly to the longitudinal axis of the tube section. Molten plastic molding compound can be injected, or the cavity can be vented, particularly effectively through such an opening into the cavity of the core element.

It is also preferred that the at least one second opening has a longitudinal axis which is disposed at least substantially perpendicularly to the longitudinal axis of the tube section; such a situation entails considerable advantages from a production-engineering standpoint, in particular together with the above-described arrangement of the first opening.

Within the context of another preferred embodiment, it is provided that the core element comprises a coupling section, which protrudes freely from the molded-on bristle element, for connecting the applicator element to the shaft section or the handle section. Such an embodiment is advantageous in that the plastic for the bristle element and the bristles can be selected regardless of the fact that the material of the coupling section has to have a certain minimum hardness and minimum strength in order to be able to fulfill its function. At the same time, the coupling action improves considerably if the coupling section and the tube section acting as a support for the bristle element are produced integrally.

It is preferably provided that the core element, in the area of its coupling section, comprises a preferably circular ring-shaped sealing surface closed in itself in the circumferential direction with which the core element rests against a complementary sealing section of the injection mold during the production of the bristle element, thus substantially preventing the mold compound forming the bristle element from entering the area of the coupling section. Ideally, the sealing section, from its inside, is put directly under the pressure with which the liquid plastic molding compound is injected which then forms the bristle element. In this case, the sealing section is preferably dimensioned to be so thin-walled that it tends to expand from the inside more than just inconsiderably under the influence of said pressure and in this way is pressed against the complementary sealing surface of the injection mold more strongly. In other words, the sealing surface is at least substantially formed in an area of the core element that is hollow inside.

Preferably, the outer jacket of the tube section is provided with additional means for retaining in a positive fit the bristle element enveloping the core element, preferably in the shape of outwardly protruding pins or teeth. Expediently, these pins or teeth protrude only locally, which in any case is only the case if they cover a maximum of ⅙, better only ⅛ of the surface of the imaginary circumferential ring from which they protrude radially outwardly. Preferably, these additional means are at the same time configured as supporting organs that center the tube section within the injection mold in which the tube section is inserted in order to be overmolded, so that it assumes a defined position. Ideally, the supporting organs are at the same time configured to be so strong that they, due to their massive bracing against the inside of the injection mold, prevent the tube section from substantially expanding or even bursting under the pressure of the plastic melt injected into its cavity. In order to be able to fulfill this last function, the supporting organs are arranged in groups which, viewed in the longitudinal direction of the tube section, are themselves disposed uniformly distributed over the tube section. In any case, the totality of the supporting organs is disposed on the tube section in such a way that the latter is substantially uniformly supported.

Preferably, the applicator according to the invention is used as a part of a cosmetics system which is composed as follows:

Cosmetics system, consisting of a cosmetics applicator of the type described in this application and a cosmetics mass, which is to be applied with this cosmetics applicator and comprises the following constituents: 10%-40% film-forming polymer (natural or synthetic) and/or 10%-50% neutralized stearic acid and/or 5%-50% non-ionic emulsifier and/or 3%-20% natural or synthetic waxes or mixtures of such waxes and/or 0%-20% natural and/or synthetic oils and/or esters and mixtures of the aforementioned substances, preferably only partially volatile, and/or 5%-25% organic or inorganic pigments, optionally including carbon black, and/or 0%-3% antioxidants and/or 0%-3% preservatives.

Further advantages, optional embodiments and mechanisms of action of the invention become apparent from the following description of the invention with reference to the Figures which show two different exemplary embodiments.

DETAILED DESCRIPTION OF THE PREFERRED EMBODIMENTS

First of all, a definition that is generally valid for the invention must be given for the terms "distal" and "proximal". Distal means "facing away from the handle section of the applicator" and proximal means "facing towards the handle section of the applicator". Thus, the distal end of the applicator element 4 or of the core element 5 is the end that, if the applicator element 4 or the core element 5 is mounted as intended, faces away the furthest from the handle section of the applicator.

Figure 7:
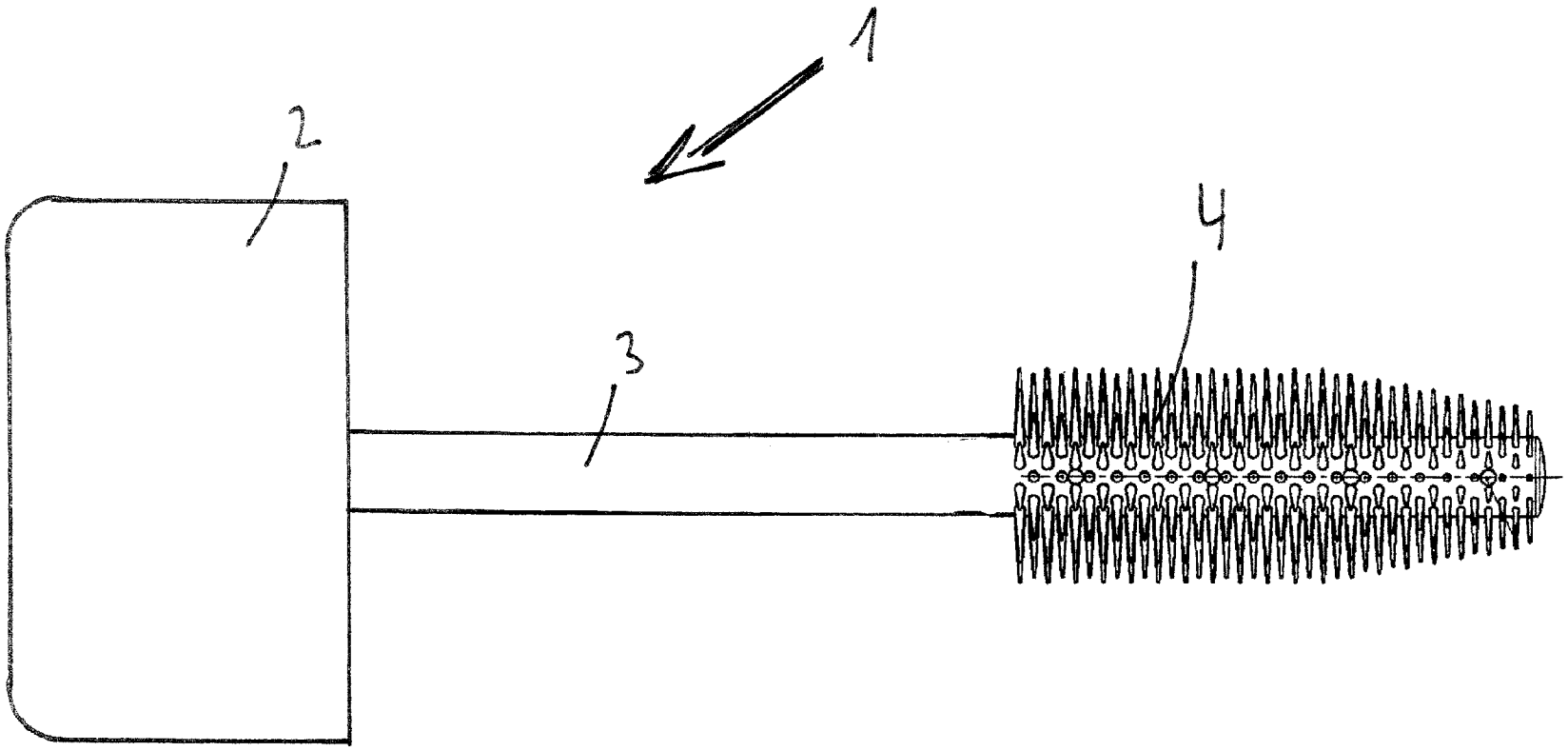
FIG. 7 shows a complete view of a cosmetics applicator according to the invention.

As can best be seen in FIG. 7, the cosmetics applicator 1 according to the invention consists of a handle section 2 which is connected to an applicator element 4 by means of a shaft section 3.

Figure 1:
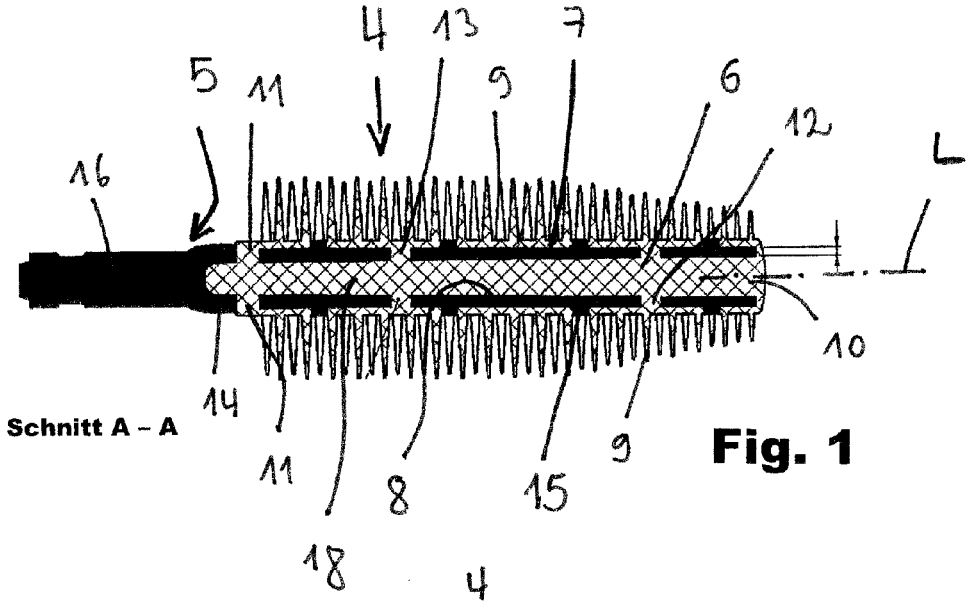
FIG. 1 shows a section through a first exemplary embodiment along the line A-A.
Figure 4:
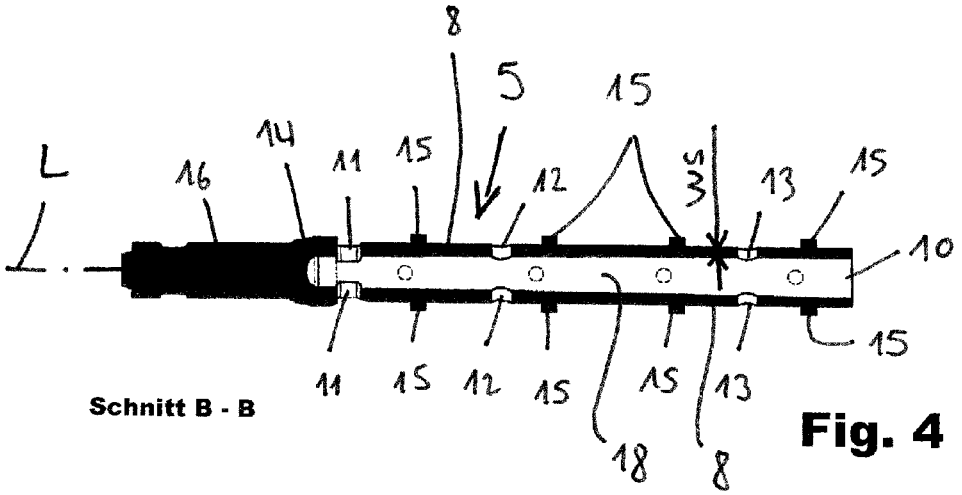
FIG. 4 shows a section through a core element as used by the first exemplary embodiment of the invention.

According to FIG. 1, the actual applicator element 4 itself consists of a core element 5 of the type shown in FIG. 4 and a bristle element 6. The bristle element 6 consists of a central part surrounding and filling the core element 5 in the manner which is to be explained in more detail later, and an area of bristles 9 that freely protrude outwardly therefrom in the radial direction. The outermost part of said central part forms a kind of imaginary bristle carrier tube 7 which serves as an attachment base for the bristles 9, because the bristles are anchored on this bristle carrier tube with their bases.

Figure 5:
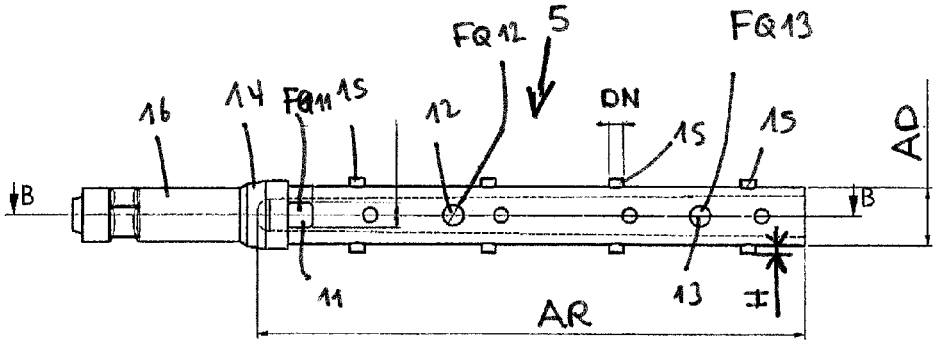
FIG. 5 shows a side view of a core element as used by the first exemplary embodiment of the invention.
Figure 6:
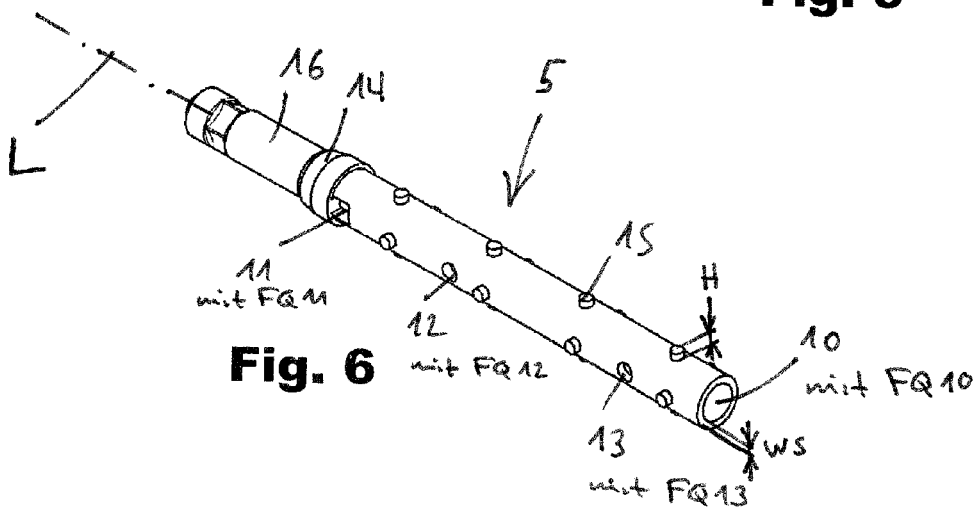
FIG. 6 shows a perspective view of a core element as used by the first exemplary embodiment of the invention.
Figure 8:
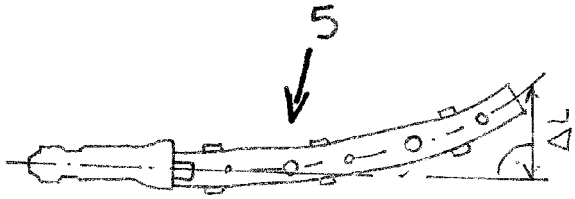
FIG. 8 illustrates the flexibility of a core element as used by the invention.

The production of the applicator element according to the invention is started with a core element 5 as it is shown in FIGS. 4 and 5. This core element is produced as a separate element which is at first not connected to other components. The core element may consist of a variety of materials. Preferably, it will be made from plastic but it may also consist of metal, for example. If the core element is made from plastic, production preferably takes place by means of injection molding. In most cases the core element 5 will consist of a comparatively hard material, and, due to the choice of its material and its geometrical configuration, it will be so rigid that it is deformed only to such an extent, under the influence of the forces acting on the finished applicator during application, that the center line on the distal end of the core element, in the loaded state of the core element, deviates from the center line L of the core element in the unloaded state by an amount ΔL that is no greater than 3 times, and better only by maximally 1.5 times the diameter of the core element, see FIG. 8.

This core element 5, as will be explained in more detail later, is overmolded with a plastic molding compound which forms a bristle element 6 comprising bristles 9 integrally attached thereto, i.e. bristles that consist of the same material as the rest of the bristle element, and that are manufactured together with it in a single step. Preferably, this plastic molding compound has a considerably greater elasticity than the material of the core element 5. Given a corresponding dimensioning of the respective bristles, bristles are therefore obtained which are so elastic that their center line (relative to the position of the center line of the unloaded bristle) can be deflected at its outermost end by an amount ABL which corresponds to at least 4 times and better at least 6 times the maximum bristle diameter $D_{max}$ that the bristle has in the area of its largest cross section, without the capacity of the bristle to spring back completely into its unloaded position being affected, see FIG. 9.

The core element 5 itself consists of a coupling section 16 with a preferably continuously massive cross section as well as of a tube section 8.

The coupling section 16 serves for connection to the shaft section 3.

The tube section 8 has the shape of a preferably round tube or of a tube with a polygonal cross section. This means that the tube section 8 has on its inside a cavity 18 whose greatest extent substantially extends in the direction along the center line L. The cavity is substantially disposed around the center line L or even concentrically therewith. In this case, the tube section is provided with at least one first opening 10 through which the melt forming the bristle element 6 can enter the tube section or exit therefrom, and with at least one second opening 11 through which the melt forming the bristle element 6 can exit from the tube section or enter it.

The at least one opening 10 is inserted in the area of the distal end of the core element 5 and preferably lies completely within an area whose surface is no more than 6 mm and ideally no more than 4 mm distant from the distal end of the core element 5. Ideally, the opening 10 even coincides with the distal end because the opening 10 is formed in the distal end face of the core element 5, so that its free cross sectional area forms a plane which is positioned substantially perpendicularly to the center line L.

The at least one second opening 11 is inserted in the vicinity of the coupling section 16 and preferably lies completely within an area whose surface is no more than 6 mm and ideally no more than 4 mm distant from the transition to the coupling section 16. Ideally, the at least one second opening 11 is even directly adjacent to the coupling section 16. Optimally, several second openings are provided which are substantially or completely diametrically opposite from one another on the circumference of the tube section 8. Such an arrangement is very expedient particularly if the melt forming the bristle element 6 is supposed to be injected from the side via at least one of the first openings or re-enters the tube section through one of these openings. For a certain "penetrating injection" thus becomes possible and prevents the radially inwardly injected melt from impacting excessively on the opposite side against the closed surface of the warm and thus delicate tube section wall and deforming it.

Such an arrangement of the at least one opening and the at least second opening ensures that the core element 5 can be overmolded completely, with the required accuracy and, above all, with the high speed required for forming all the fine bristles with a plastic molding compound forming the required bristle element 6.

Preferably, the core element 5 is equipped with at least one further third opening which is located in the area of the core element extending between the at least one first opening and the at least one second opening. Ideally, several third openings are even provided, preferably two (possibly, but clearly not preferred, even three, or in rare exceptions even four) third openings that are disposed substantially along a circumferential line extending around the core element 5 perpendicularly to the center line or longitudinal axis L. Preferably, several third openings are diametrically opposed to one another in the manner already described above with regard to the second openings.

Preferably, the core element 5, in addition to the third opening or openings, is also equipped with at least one fourth opening. This is located in the area of the core element extending between the third opening or openings and the at least one first opening. Ideally, several fourth openings are even provided, preferably two (possibly, but clearly not preferred, even three, or in rare exceptions even four) fourth openings that are disposed along a circumferential line extending around the core element perpendicularly to the center line or longitudinal axis L. Preferably, these fourth openings are diametrically opposed to one another in the manner already described above with regard to the second openings.

In order to obtain a good injection result, the dimensioning of the first to fourth openings and of the core element 5 is of crucial importance. Dimensioning is also dependent on the properties of the plastic molding compound that is used for producing the bristle element 6. Therefore, the person skilled in the art must and is able to determine for the respective individual case the exact dimensioning of the first to fourth openings that is optimal for the specific individual case by tests that are common in the field. Based on the basic data specified herein that already substantially limit the possible range within which an optimization must be carried out, this is possible with relatively little effort that can be managed routinely.

The core element 5 should preferably have an external diameter AD, wherein: 2 mm≤AD≤5 mm. Preferably, the following applies: 2 mm≤AD≤4 mm.

The wall thickness of the core element 5 in the area of its tube section 8 should comply with the following equation: 0.18 mm≤WS≤0.75 mm.

The axial length AR of the tube section 8 should be between a minimum of 5 mm, better a minimum of 10 mm and a maximum of 35 mm, better a maximum of 30 mm.

Every second opening 11 has a free cross section FQ 11 whose surface area corresponds to a surface area of a circular hole with a radius of between 0.6 mm and 1.8 mm. The same (FQ 10) applies to every first opening 10 unless this first opening is formed in the end face of the core element 5; in that case, its free cross section results from the above-mentioned relations for the external diameter of the core element 5 and the wall thickness of the core element 5.

Every third and fourth opening 12 or 13, respectively, has a free cross section (FQ 12 and FQ 13, respectively) whose surface area corresponds to the surface area of a circular hole with a radius of between 0.6 mm and 1.5 mm.

As can be seen rather well in FIGS. 4 and 1, the core element 5 is provided with a number of supporting organs 15 configured as locally limited projections that do not extend over the entire circumference and which protrude over the outer circumference of the core element 5—these projections may be referred to as islands that protrude over the outer circumference of the core element 5 with a height H of 0.2 mm to 0.8 mm. In the preferred embodiment shown by FIGS. 4 and 5, said supporting organs 15 are configured in the shape of cylinder sections whose diameter DN is preferably ≥0.4 mm and preferably ≤2 mm. If the supporting organs are not configured in the shape of cylinder organs but differently, they should preferably comprise a free surface provided for bracing against the injection mold which corresponds to the surface of cylinder sections whose diameter are within the aforementioned range.

Figure 2:
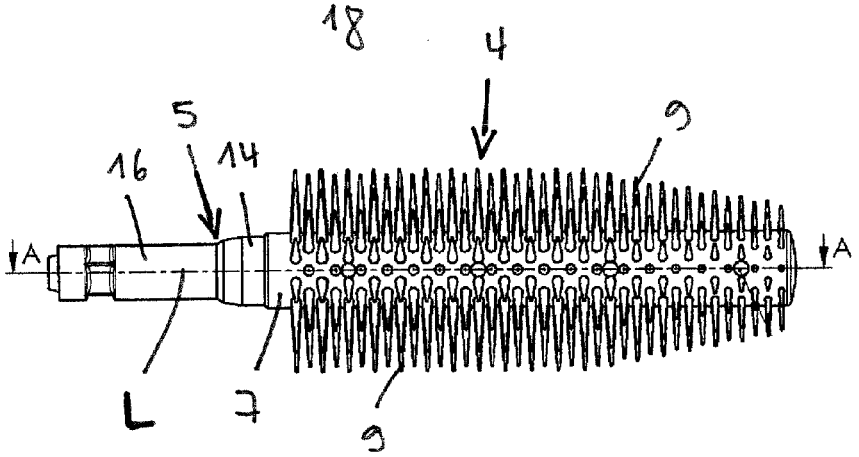
FIG. 2 shows a side view of a first exemplary embodiment of the invention.

These supporting organs are configured in such a way that the core element braces itself with them against the surrounding inner wall of an injection mold, into which the core element 5 has been inserted in order to overmold in a second working step the core element 5 with a plastic molding compound which forms a bristle element 6, as the FIGS. 1 and 2 show. Such a bracing action at least effects a centering of the core element in the mold. Preferably, the supporting organs are, however, configured to be so strong that they prevent the tube section 8 from being deformed excessively or being broken open under the influence of the internal pressure which the melt which later forms the bristle element 6 exerts thereon. For it is not desired that the tube section, under the influence of the internal pressure occurring during the injection process in its cavity, is deformed in such a way that the uniformity of the wall thickness of the bristle carrier tube suffers. Because a more than only inconsiderable irregularity affects the purchase or even the formation of the bristles.

In this manner, it is preferably ensured that, between the inner surface of the injection mold, from which the bristle-forming channels branch off, and the circumferential outer surface of the core element, a defined annular space with a gap height of preferably 0.2 mm to 0.8 mm, or in individual cases even up to 1.2 mm, remains free, through which the liquid plastic molding compound can be fed to the bristle-forming mold cavities during injection and which later forms the bristle carrier tube 7.

Furthermore, the core element 5 has on the side of its coupling section 16 an annular first sealing section 14 which is suitable and intended for sealing contact with the inner surface of the injection mold that accommodates the core element 5 when it is overmolded with the plastic molding compound that later forms the bristle element.

It is to be noted in this connection that the sealing section 14 lies in an area which is directly exposed from the inside to the pressure of the plastic molding compound with which the core element 5 is overmolded. In this way, a good sealing function is obtained, for the plastic molding compound tends to expand the sealing section 14 so that its diameter tends to increase, which in turn causes the sealing section 14 to be pressed well against the inner surface of the injection mold accommodating it, so that a reliable and accurately separating sealing function is obtained without any great effort. This is significant particularly if the core element 5 is overmolded with a plastic molding compound colored differently.

In the overmolding of the core element 5 with the plastic molding compound that later form the bristle element 6, the procedure is preferably such that this plastic molding compound is completely or at least predominantly first injected into the cavity of the tube section 8, preferably via the opening on the end face located at the distal end of the tube section 8, which in this exemplary embodiment forms the first opening. The injected plastic molding compound then spreads in the cavity and exits through the second, and optionally also the third and fourth openings into the outer area where it then forms the bristle carrier tube 7 and, above all, the bristles 9 rooted thereto. In this case, the core element is preferably configured in such a way that the plastic molding compound that is liquid during the injection process, following its exit from the second, third and/or fourth opening(s), has to flow in the longitudinal direction along the gap or annular gap between the inner surface of the injection mold and the outer surface of the core element to a certain extent, in order to fill all the form-forming cavities in this area.

This kind of injection of the plastic molding compound has a decisive influence on the macroscopic properties of the plastic molding compound forming the bristle element 6. On its way from the cavity of the tube section through the various openings into the gap or annular gap shaping the bristle carrier tube and thence into the capillaries shaping the individual bristles, the plastic molding compound is stretched. A pronounced orientation is thus imposed on the long-chained plastic molecules forming the bristles, which is reflected in improved properties of the bristles (for example in a better bend recovery). In this way, the performance characteristics of the bristles come closer to the advantageous performance characteristics of bristles of extruded or spun filaments.

As can best be seen in FIG. 1, the regular cavity formed, thanks to the supporting organs, between the outer circumference of the core element 5 and the inner circumference of the injection mold accommodating it is filled completely by the plastic material that is molded on later. The latter forms a section in said cavity that can best be referred to as a bristle carrier tube 7 on whose outer circumference the bristles are rooted, i.e. from which the bristles protrude in the radial direction. However, the bristle carrier tube is not isolated but is integrally connected to the plastic molding compound filling the core or the cavity of the bristle carrier tube 7, via the various openings in the tube section 8 of the core element 5. In this manner, an intimate bond between the core element and the bristle element is produced which prevents, under any circumstances, that the bristle element is detached from the core element and displaced relative to it under the forces occurring during use—even if totally different plastic molding compounds or materials that can neither be welded not glued together are used for the core element and the bristle element.

In this case, it is remarkable that the tube section 8 of the core element 5, in the finished state of the applicator element 4, is substantially completely (as a rule, more than 90%) surrounded by the plastic molding compound of the bristle element 6, i.e. is substantially completely embedded therein. It is thus prevented that separating joints between the material of the core element and the material of the bristle element that are accessible from the outside occur in any significant degree, which could be populated by bacteria or germs in unfavorable circumstances.

Figure 9:
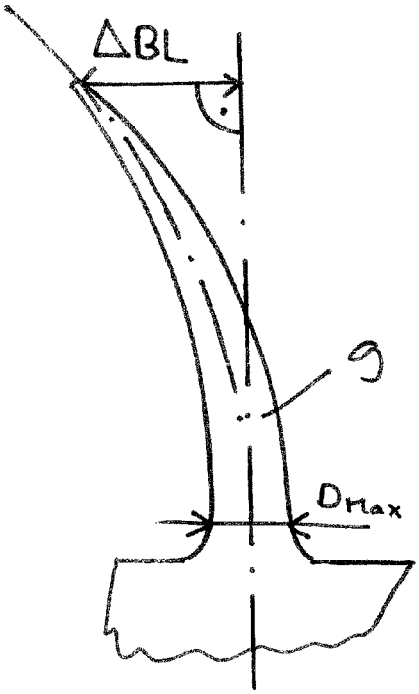
FIG. 9 illustrates the flexibility of a bristle as used by the invention.
Figure 10:
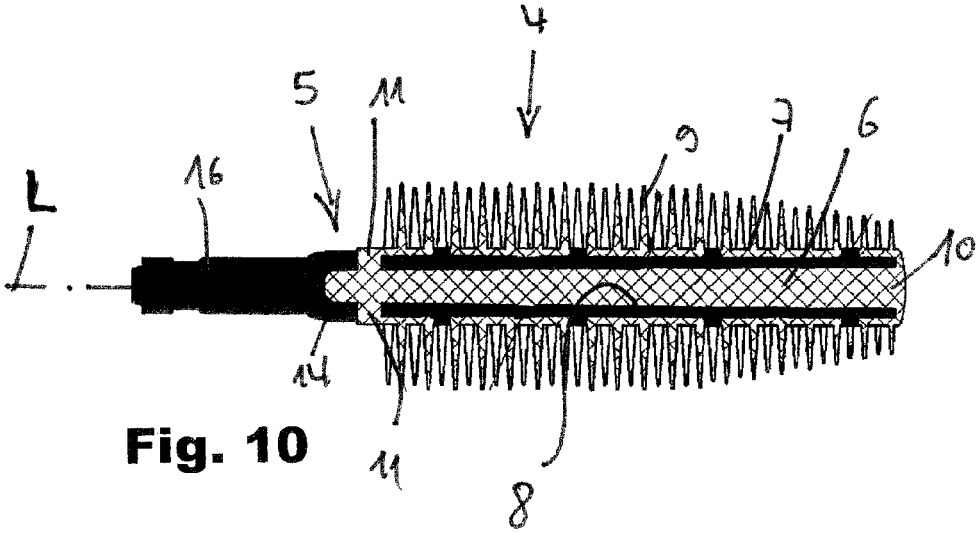
FIG. 10 shows a second exemplary embodiment of the invention which completely matches the first exemplary embodiment with the exceptions explained in the text.

FIG. 9 shows another advantageous exemplary embodiment.

This exemplary embodiment completely corresponds to the above-described exemplary embodiment (so that the statements there also apply here) with the exception of the fact that this exemplary embodiment does not comprise third and fourth openings, but only a first opening in the distal end face of the core element and two (not shown: in exceptional cases also three or in rare exceptions four) second openings, preferably in the direct vicinity of the coupling section 16. Such an embodiment may have advantages with regard to injection molding and may therefore be advantageous over the first embodiment.

Figure 3:
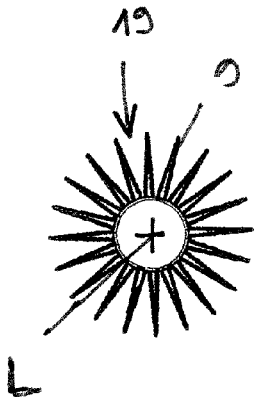
FIG. 3 shows an interference view of a first exemplary embodiment of the invention.

Especially given this particular type of overmolding of a core element, it was found for all exemplary embodiments that it is expedient to optimize the bristle covering for this special kind of production, namely as follows:

The bristles are preferably divided into finger rings 19, see FIG. 3. Each finger ring 19 consists of a number of n bristles which, seen in the circumferential direction, stand one behind the other or at least substantially one behind the other (up to ±0.9, better only up to ±0.5 bristle diameter lateral deviation from the circumferential line). A number of N finger rings substantially forms the entire bristle covering of the applicator protruding in the radial direction. Preferably, the following applies: $14<N<44$ and $6<n<32$. Ideally, the following applies: $19<N<31$ and $10<n<25$.

Preferably, the bristles are configured conically and taper towards their outer end. These bristles are preferably configured in such a way that their free length with which they protrude from the bristle carrier tube is at least five times, better at least seven times larger than their largest diameter—in all or at least the predominant number of the bristles.

Together with such a bristle covering or with the applicators according to the invention, especially adapted mascara masses are preferably being used which are composed as follows:

10%-40% film-forming polymer (natural or synthetic)
10%-50% neutralized stearic acid
5%-50% non-ionic emulsifier
3%-20% natural or synthetic waxes or mixtures of such waxes
0%-20% natural and/or synthetic oils and/or esters and mixtures of the aforementioned substances, preferably partially volatile
5%-25% organic or inorganic pigments, optionally including carbon black
0%-3% antioxidants
0%-3% preservatives.

The invention claimed is:

1. A cosmetics applicator, comprising:
a handle section;
an applicator element; and
a shaft section connecting the applicator element and the handle section;
wherein the applicator element includes a core element of a first material and a bristle element which at least partially envelops the core element, and which includes a second material different from the first material with regard to its hardness and/or flexibility, and the core element comprises a tube section which is hollow on the inside in a direction along its longitudinal axis and thus forms a cavity, wherein said cavity is filled by the second material of the bristle element and the bristle element, integrally therewith, at the same time forms a bristle carrier tube covered with outwardly protruding bristles which envelops an outer jacket of the tube section at least in some areas.

2. The cosmetics applicator according to claim 1, wherein the tube section of the core element, in an area of a distal end thereof facing away from the handle section, comprises at least one first opening through which material can be injected into the cavity of the core element during production of the cosmetics applicator, and the tube section of the core element, in an area of a proximal end thereof facing towards the handle section, comprises at least one second opening through which the previously injected material can exit the cavity of the core element again during the production of the cosmetics applicator in such a way that the material exiting again forms at least a part of the bristle carrier tube enveloping the outer jacket of the tube section.

3. The cosmetics applicator according to claim 2, wherein the bristle element also covers the distal end face of the core element completely, so that the tube element is completely embedded in the interior of the bristle element.

4. The cosmetics applicator according to claim 2, wherein a mouth of the at least one opening pointing outwards lies at least substantially in a plane extending perpendicularly to the longitudinal axis of the tube section.

5. The cosmetics applicator according to claim 2, wherein the at least one second opening has a longitudinal axis which is disposed at least substantially perpendicularly to the longitudinal axis of the tube section.

6. The cosmetics applicator according to claim 1, wherein the tube section of the core element is substantially enveloped by the bristle element.

7. The cosmetics applicator according to claim 1, wherein the core element comprises a coupling section which protrudes freely from the bristle element, for connecting the applicator element to the shaft section or the handle section.

8. The cosmetics applicator according to claim 7, wherein the core element, in an area of its coupling section, comprises a sealing surface with which the core element rests against a complementary sealing section of an injection mold during the production of the bristle element, and thus substantially prevents a mold compound forming the bristle element from entering the area of the coupling section.

9. The cosmetics applicator according to claim 8, wherein the sealing surface is formed in an area of the core element which is hollow inside.

10. The cosmetics applicator according to claim 1, wherein the outer jacket of the tube section is provided with outwardly protruding pins or teeth for retaining in a positive fit the bristle element enveloping the core element.

11. A cosmetics system, comprising the cosmetics applicator according to claim 1 and a cosmetics mass, which is to be applied with this cosmetics applicator and comprises at least one of the group consisting of:

10%-40% film-forming polymer (natural or synthetic);

10%-50% neutralized stearic acid;

5%-50% non-ionic emulsifier;

3%-20% natural or synthetic waxes or mixtures of such waxes;

0%-20% natural and/or synthetic oils and/or esters and mixtures of the aforementioned substances;

5%-25% organic or inorganic pigments;

0%-3% antioxidants; and

0%-3% preservatives.

* * * * *